US005533286A

United States Patent [19]

Fallon et al.

[11] Patent Number: 5,533,286

[45] Date of Patent: Jul. 9, 1996

[54] LUMINOUS ELECTRIC SIGN

[76] Inventors: Timothy R. Fallon, 15 Avian Trail, Columbia, S.C. 29206; Walter K. Tanner, Jr., 604 Montgomery Dr., Chesnee, S.C. 29323

[21] Appl. No.: 262,007

[22] Filed: Jun. 17, 1994

[51] Int. Cl.[6] ..... G09F 13/26

[52] U.S. Cl. ..... 40/545; 362/812

[58] Field of Search ..... 40/545, 564, 575, 40/580; 362/812

[56] References Cited

U.S. PATENT DOCUMENTS

| | | | |
|---|---|---|---|
| 1,570,980 | 1/1926 | Wiegand | 40/545 |
| 1,654,255 | 12/1927 | Hendry . | |
| 1,872,428 | 8/1932 | Drury | 40/545 |
| 1,917,956 | 7/1933 | Earley | 40/545 |
| 2,082,523 | 6/1937 | Segal . | |
| 2,763,948 | 9/1956 | Hilgedick . | |
| 3,085,224 | 4/1963 | Becka . | |
| 4,903,172 | 2/1990 | Schöniger et al. . | |
| 5,267,404 | 12/1993 | Kizy | 40/545 |

OTHER PUBLICATIONS

A 16-page brochure, *GLOLITE, signs of Success,* Nu-Dell Mfg. Co, Inc., Des Plaines, IL 60018.

*Primary Examiner*—Brian K. Green
*Attorney, Agent, or Firm*—Hardaway Law Firm

[57] ABSTRACT

An electric luminous display unit for conveying visual information including a housing comprising an opaque front face portion of substantially rigid molded plastic, an elongated groove in the front face portion of the housing, inert gas-containing glass tubing located in the groove and extending therealong, and electrical means located behind the front face portion of the housing and electrically connected to ends of the glass tubing for supplying electrical energy to illuminate the same.

4 Claims, 5 Drawing Sheets

LUMINOUS ELECTRIC SIGN

This invention relates to a luminous electric display unit of the inert gas-containing tube type and, more particularly, to such a display unit having an improved housing of simple and economical construction for supporting and protecting the lighting and electrical components of the sign.

BACKGROUND OF THE INVENTION

Luminous electric signs of the inert gas-filled tube type have long been employed in commercial and business establishments to provide decoration and/or impart information. Typically, such signs are referred to as "neon signs" and may be hung or placed in various locations, such as storefront windows, to advertise a product, decorate, or provide message information.

The tubular lighting elements of the sign may be conformed into an array of desired letters or decorative shapes, as in a glass tube-bending operation, and the array is supportably attached by suitable brackets or wires to a rigid open frame, to a support backing, or in some form of housing or box.

In luminous signs of the neon tube type, it is desirable to protect the glass tubular lighting array from breakage, and to protect the various elements the sign from collecting dust, foreign particles, and the like. In daylight conditions, it is often desirable that the lighted tubular array be backed by an opaque material for light containment and to provide solid background for better visibility of the sign.

It is also known to provide luminous electric display units, typically called electric blackboards, wherein a fluorescent or photoconductive plate, such as an acrylic plastic board, is edge lighted by a light-emitting element to concentrate light in the board whereby hand written information placed thereon by suitable means, such as water-soluble erasable high-pigment crayons, has a glow or brightness to display the information contained on the board.

Luminous electric display units of the types described are disclosed in the following U.S. Patents:

| | |
|---|---|
| U.S. Pat. No. 1,654,255 | U.S. Pat. No. 2,082,523 |
| U.S. Pat. No. 2,763,948 | U.S. Pat. No. 3,085,224 |
| U.S. Pat. No. 4,903,172 | |

BRIEF OBJECTS OF THE PRESENT INVENTION

It is an object of the present invention to provide a luminous electric display unit of the inert gas-filled tube type having a support housing for the lighting array and electrical components of the unit which is of simplified and economical construction.

It is another object to provide a luminous electric display unit which protects the lighting array and electrical elements of the unit against glass breakage and contamination by dust and foreign matter.

It is a further object to provide a display unit having an improved support housing for the electrical and lighting elements of the unit to provide an improved high visibility to the lighting elements over conventional methods.

It is a further object, in one form the invention, to provide a display unit additionally having an edge-lighted message board which can be engraved with a message or written on with fluorescent markers and which can be combined with a lighted portion to display information apart from the edge-lighted message board.

It is another object to provide a display unit of two-piece housing construction having a face portion for display of lighted information and a back portion forming a compartment to contain and hide transformer and wiring components of the display unit.

BRIEF DESCRIPTION OF THE DRAWINGS

The above as well as other objects of the invention will become more apparent, and the invention will be better understood, from the following detailed description of preferred embodiments of the invention, when taken together with the accompanying drawings, in which.

DETAILED DESCRIPTION OF PREFERRED EMBODIMENTS

Figure 1:
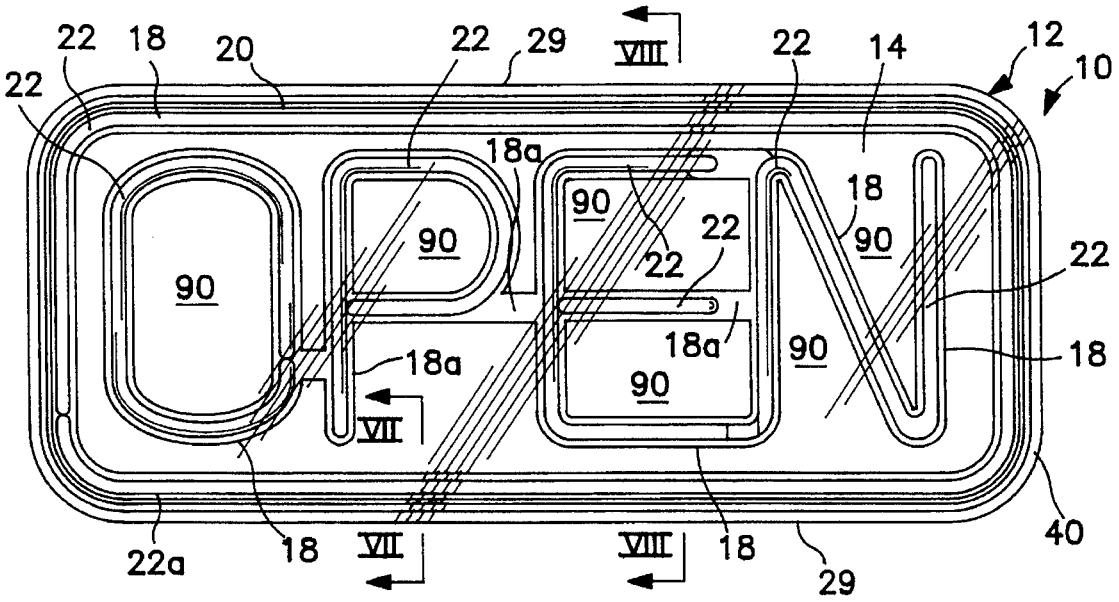
FIG. 1 is a front elevation view of a first embodiment of an electric luminous display unit of the present invention.
Figure 2:
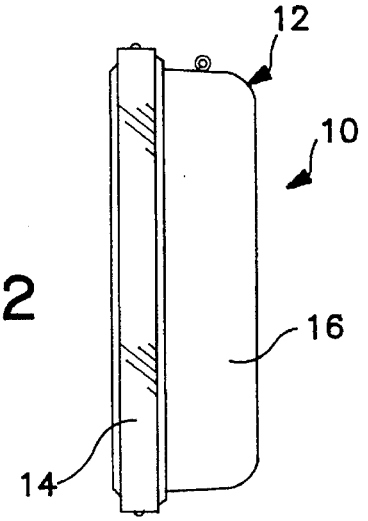
FIG. 2 is a right side elevation view of the display unit of FIG. 1.

Referring now more particularly to the drawings, FIGS. 1–8 show, in the various views, one embodiment of the present invention. As seen, the electrical luminous display unit 10 includes a support housing 12 having a substantially planar front face portion 14, and a rear closure portion 16, both formed of suitably rigid opaque plastic, such as a molded polystyrene resin, and of unitary construction. The front face portion 14 is substantanially planar except for; one or more elongated grooves 18, 20 for the receipt and protection of elongated glass tubing 22 for containing an inert gas, such as neon, which may be electrified to illuminate the tubing to convey visual information through transparent portions thereof. Substantially planar front face portion 14, in the area of closed off parts of characters, e.g., 90, does not have any cut-out portions, such as in Weigand, who, for example, removes the center from his "O" and the triangle from his "A". As shown, the visual information consists of block letters forming the word "OPEN" surrounded by a generally rectangular border of glass tubing. Finally, substantially planar front face portion 14 is recessed from a hollow lip 40 entirely surrounding the front of unit 10. Lip 40 protects glass tubing 22 from possibly hitting the window in which unit 10 may be placed as well as serves another function to be described below.

The glass tubing 22 for containing the inert gas is bent, as in a heat-shaping operation. In such shaping operation, a length of tubing, e.g., four feet, is suitably heated and bent in the shape of letters, e.g., OPEN. To separate and distinguish the letters, portions 22*a* of the length of tubing are bent to lie primarily in a plane separate from the plane of the letters of the message to be conveyed. These portions of tubing which are bent to lie in a separate plane, generally parallel to the plane of the letters, are called "transition" portions of the tubing. The transition portions 22*a* (FIGS. 4–6, and 8) are generally painted, or blacked out, to make them opaque and preclude passage of light therethrough.

Conventional electrical circuitry is present for operating the sign. End portions of the inert gas-containing tubing 22 are connected to electrodes 24 (FIGS. 6 and 8) which are in turn connected by electric wiring 26 to a transformer 28 which conventionally converts energy from a power source (not shown), such as a 110V electric power supply, to high voltage energy. The gas in the tubing is thus energized in conventional manner to illuminate the tubing and transmit light through the transparent portions thereof. Substantially planar front face 14, with its general lack of any open portions in areas 90, hides and protects the electrical circuitry and provide a much neater sign appearance since the background on which the sign is hung does not show through.

As best seen in FIGS. 1, 7*a*, 7*b*, and 8, the portion of glass tubing 22 forming the visual information "OPEN" surrounded by the border tubing is received within and protected by grooves 18, 20 of generally semicircular cross-section which contain and surround a major portion of the glass tubing. The face portion 14 and grooves 18, 20 thus provide an opaque background for the illuminated tubing and concentrate the light emitted therefrom in a forward direction toward a viewer. Location of the tubing in the grooves also provides protection for the tubing. The tubing 22 is suitably mounted and retained in the grooves 18, 20 by suitable fastening means, such as a silicone adhesive 23 (FIG. 7*a*), thin copper attachment wires, or clips 25 (FIG. 7*b*) attached to the face portion 14 in the grooves 18, 20.

Figure 3:
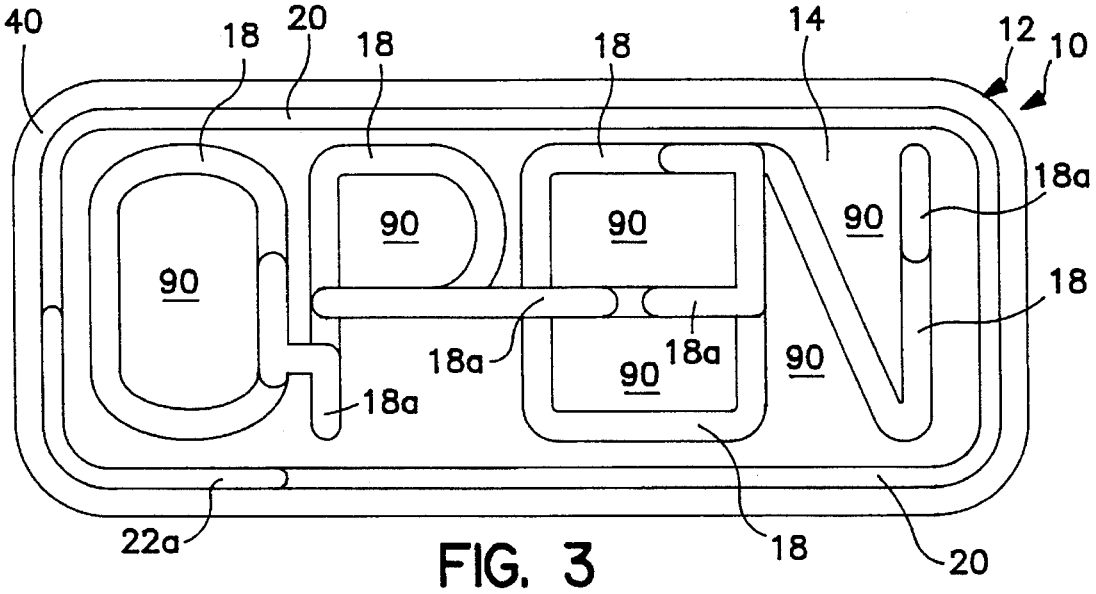
FIG. 3 is a front elevation view of the display unit of FIG. 1, with the glass tubing thereof removed to better show the grooves in and openings through the front face portion of the unit which receive and protect the tubing.
Figure 4:
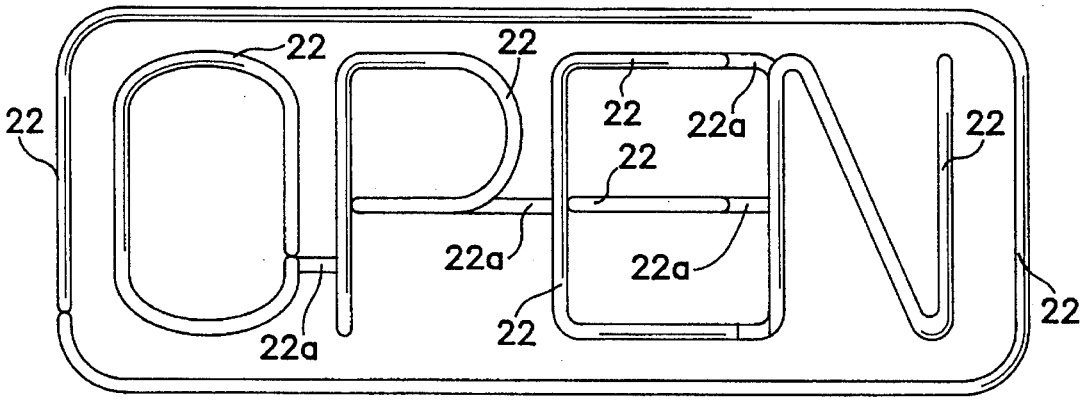
FIGS. 4 and 5 are front and rear elevation views, respectively, of the glass tubing, only, of the luminous display unit of FIG. 1.
Figure 5:
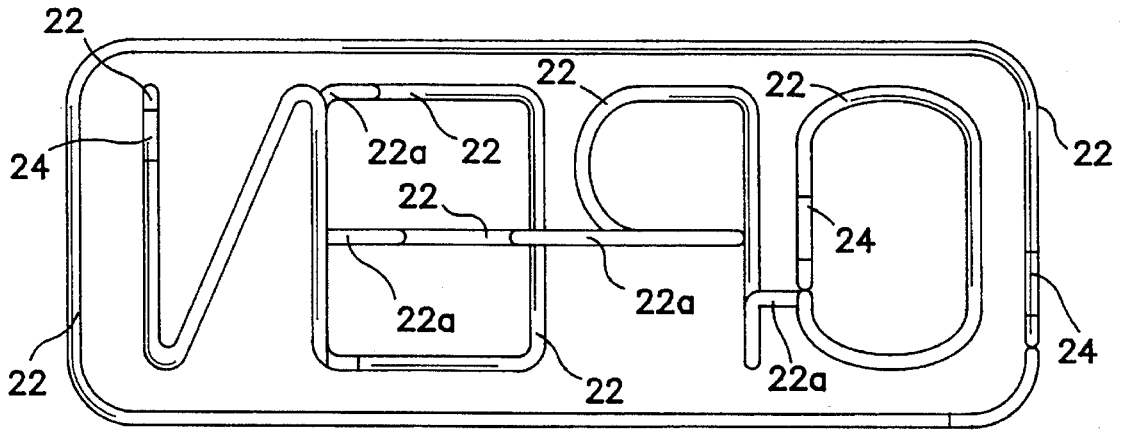
Figure 6:
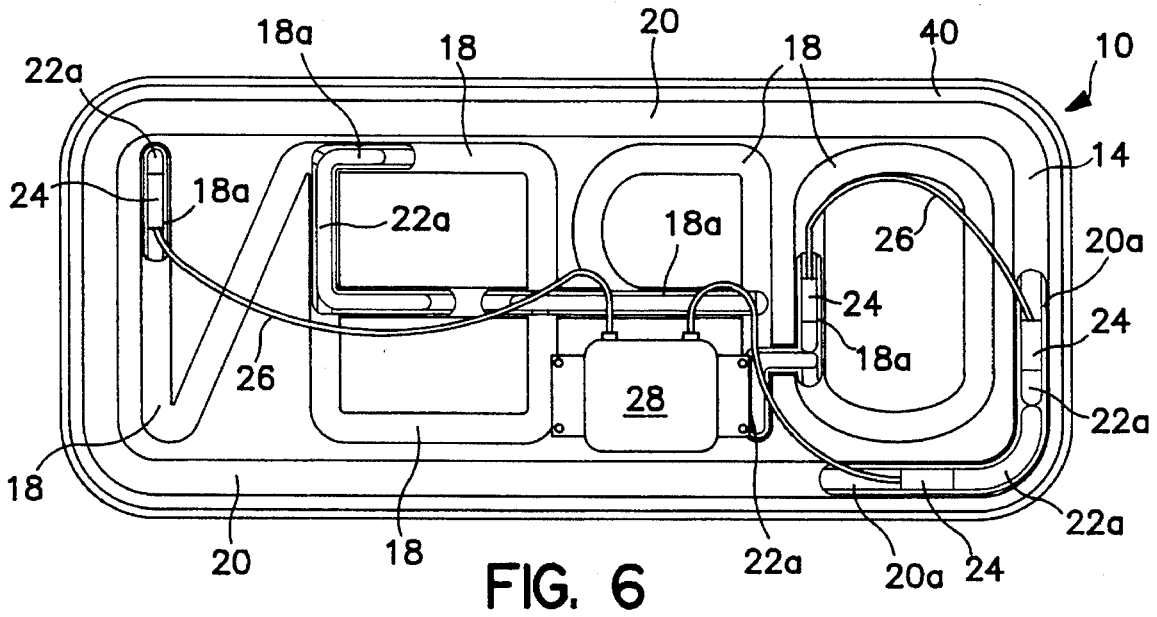
FIG. 6 is a rear elevation view of the front face portion of the unit of FIG. 1, with the rear closure portion of the housing removed, showing electrical components and openings in the front face portion for receiving portions of the glass tubing therethrough.

To protect and hide the transition portions 22*a* of the glass tubing which lie in a plane behind the plane of the letters "OPEN" and inside the housing 12, portions of the grooves 18, 20 of the front face portion 14 of the unit 10 have elongated openings 18*a*, 20*a* therethrough ( see FIGS. 3 and 6 ). These openings receive the transition portions 22*a* of the glass tubing therethrough for retention in the housing 12 of the unit, along with the electrical wiring 26, electrodes 24, and transformer 28 (see FIG. 8).

Figure 7A:
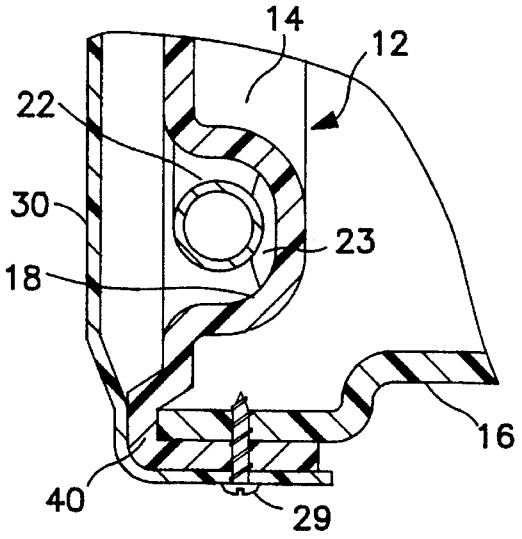
FIG. 7*a* is an enlarged, broken-away, sectional view of a groove portion of the unit shown in FIG. 1 taken generally along line VII—VII looking in the direction of the arrows thereof, and showing the position and mounting of the glass tubing a groove of the display unit.
Figure 7B:
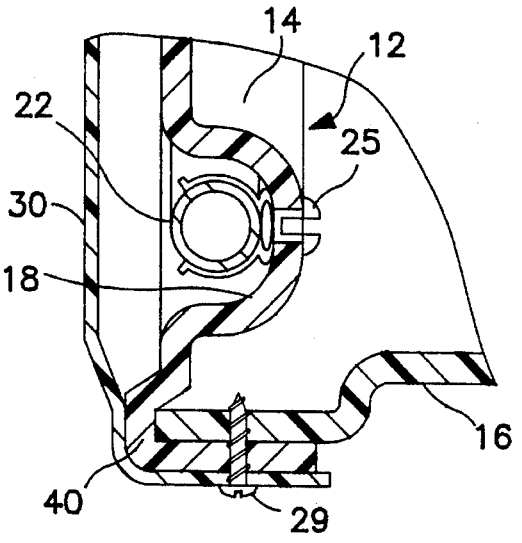
FIG. 7*b* is a broken-away, sectional view of a groove portion of the unit, as in FIG. 7*a* but showing alternate means for mounting the glass tubing in a groove of the display unit.
Figure 8:
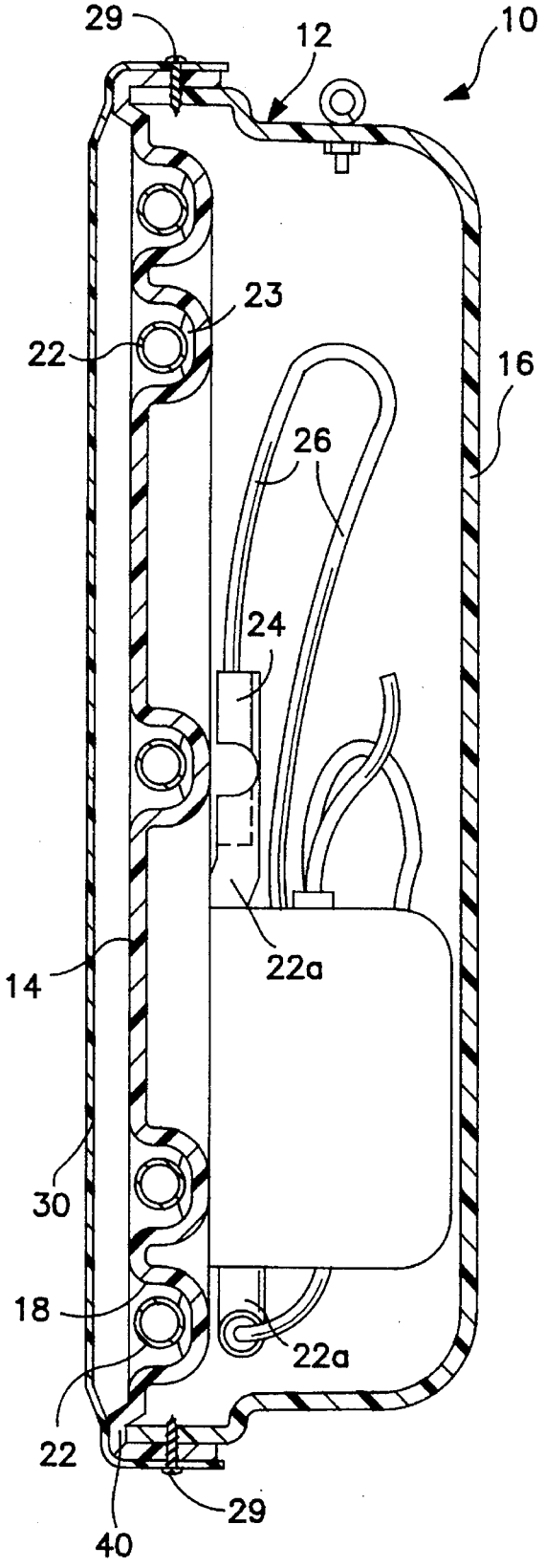
FIG. 8 in an enlarged, sectional view of the display unit of FIG. 1, taken generally along lines VIII—VIII looking in the direction of the arrows thereof, and showing internal components of the unit.
Figure 9:
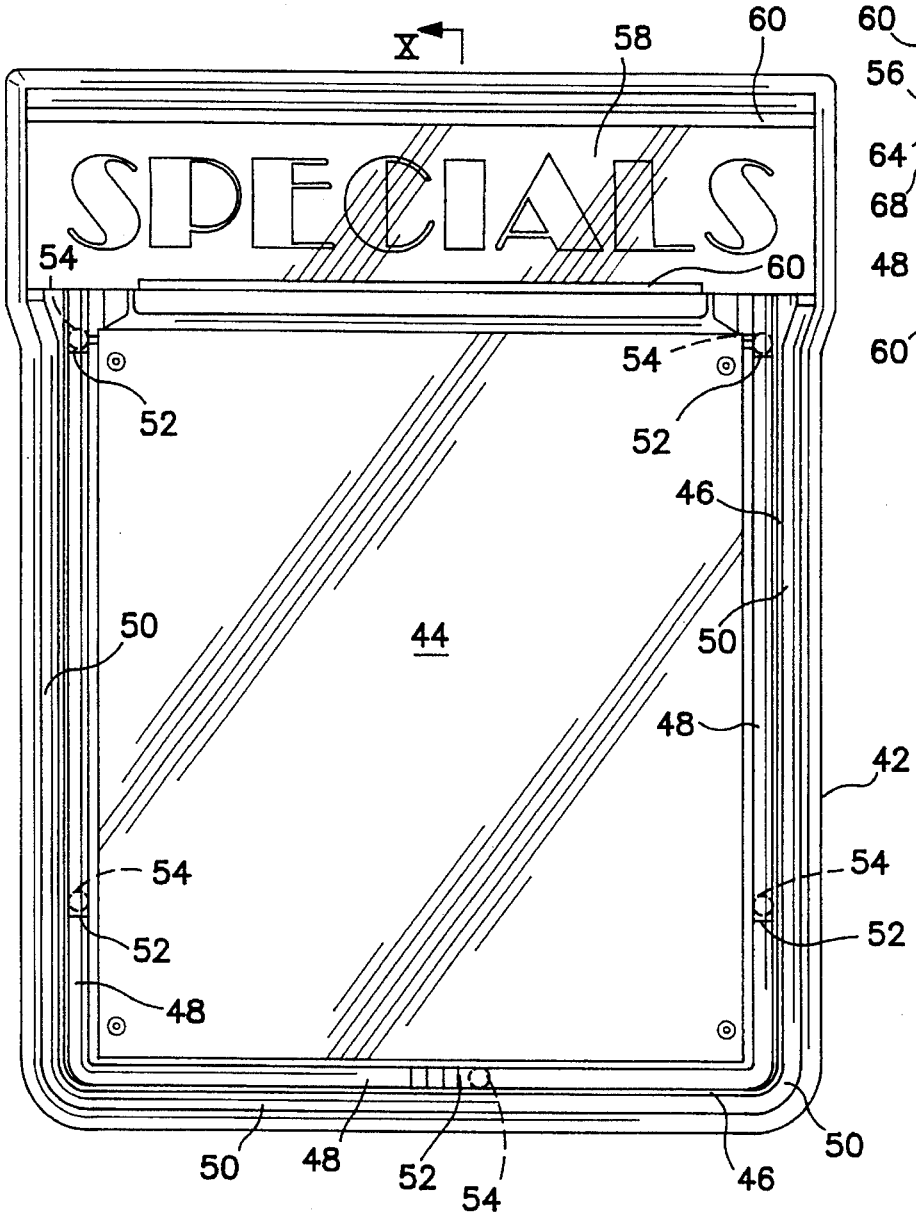
FIG. 9 is a front elevation view of another embodiment of the electrical luminous display unit of the present invention.

The rigid molded substantially planar front face of the unit portion 14 may be attached to the rear face by suitable means, such as fastening screws 29 spaced about the periphery of the unit. As shown in FIGS. 7A, 7B, and 8, edges 35 of rear portion 16 fit within the hollow portion of lip 40 to create a light- and element-tight seal. This seal results in a generally light-tight unit 10 which light and the elements cannot pass into except through openings 18*a*, 20*a*, which are substantially blocked by transitions 22*a* anyway. By having unit 10 generally black inside due to lack of light entry therein, the blending in of the transition elements with the black background will be substantially enhanced, thereby drastically improving the appearance of separation between characters or letters. If desired, in food service or outdoor use of the display unit, the face of the unit portion 14 may be further protected by a transparent cover 30 (FIG. 8).

FIGS. 7*a*, 7*b*, and 8 more particularly show the location and an arrangement for support of the glass tubing 18, 20 in the grooves by suitable adhesive 23 (FIG. 7*a*) or spring clip 25 (FIG. 7*b*). As seen, the groves are so dimensioned as to receive the full diameter of the tubing therein, thus protecting the tubes while emitted light from the tubes is concentrated and focused by the curved, non-rectangular walls of the groove in a forward-facing direction for view by the human eye.

Thus it can be seen that the display unit of FIGS. 1–8 provides a simplified, economical arrangement for supporting and protecting glass tubing and electrical components of a neon-type display sign, while providing improved visualization of the displayed information therefrom.

FIGS. 9–12 show a modified form of illuminated display unit of the present invention wherein the unit is in the form of an edge-lighted, information board for illuminating hand written information or other indicia thereon. In this embodiment, the display unit 40 comprises a support housing 42 consisting of an opaque sheet of suitably rigid plastic, such as a molded polystyrene resin, which is shaped as a front face portion to provide a flat central surface for receipt and support of a light-transmitting board 44 of rigid material, such as an acrylic plastic, on which information may be written by hand or by the placement of suitable indicia. The board 44 may have an opaque paint on its back face to facilitate light transmission through its front face.

Figure 10:
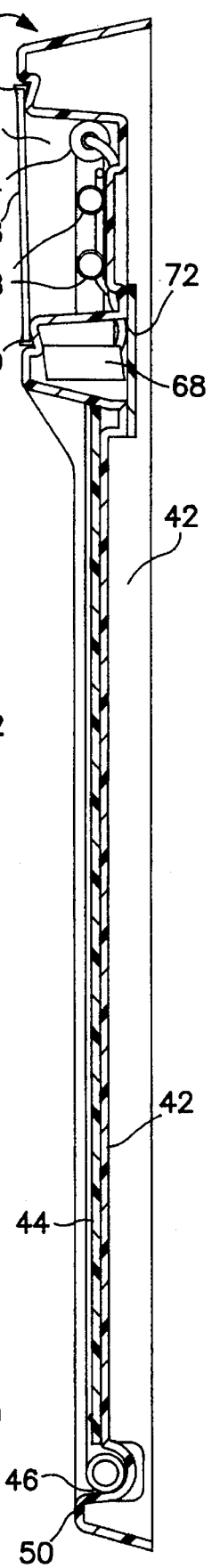
FIG. 10 is an enlarged, sectional view of the display unit of FIG. 9 taken generally along lines X—X and looking in the direction of the arrows.
Figure 12:
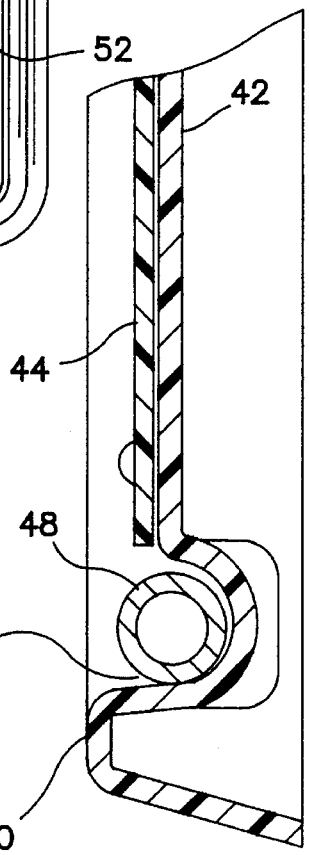
FIG. 12 is an enlarged, broken-away sectional view of a portion the unit of FIG. 11 taken along lines XII—XII and looking in the direction of the arrows thereof.

As seen, surrounding the periphery of three sides of the rectangular board 44 and located in a continuous groove 46 in the peripheral portion of support housing 42 is an inert gas-containing glass tubing 48. As seen in FIGS. 10 and 12, the glass tubing 48 is received within peripheral groove 46 of the housing to lie approximately in the plane of the transparent display board 44 so as to provide edge lighting thereto, as well as to project border lighting of the board toward the viewer, while residing within the groove and below a peripheral rim 50 of housing 42 to be protected thereby. The tubing may be suitably supported in the groove, as by copper tie wires 52, and is spaced from the bottom of the grooves by spacer pads 54 of felt or the like. Alternatively, the tubing may be attached to the front face portion of the housing by adhesive or spring clip, as in the case of the tubing in the embodiment of FIGS. 1–8.

Figure 11:
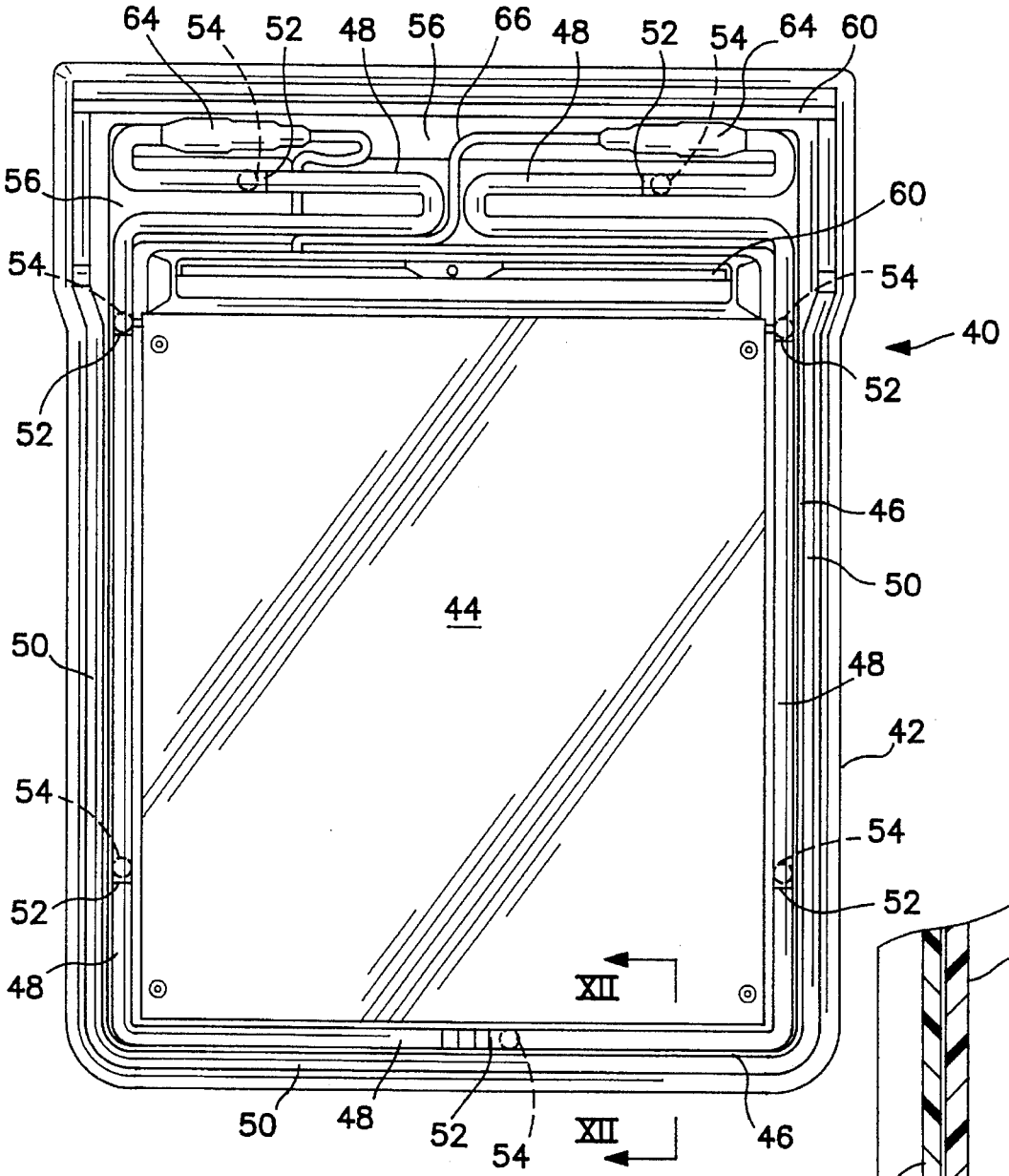
FIG. 11 is a front elevation view of the display unit of FIG. 9, with the front panel covering a compartment of the unit removed to show the interior thereof.

Located in the upper peripheral edge portion of the housing 42 is an elongated compartment 56 (FIG. 11), a front panel 58 (FIG. 9) which is slidingly received in grooves 60 to enclose end portions 62 of the glass tubing 48, electrodes 64, wiring 66, and a transformer 68 (FIG. 10) which supplies power to the unit. As seen in FIGS. 10 and 11, the housing compartment 56 is divided by a midwall 70 on which is supported the transformer 68 and a portion of the rear of the housing compartment is enclosed by a removable backplate 72.

As best seen in FIG. 12, the glass tubing 48 providing edge-lighting to the transparent display board 44 of the unit is recessed within the groove 46 with the rim 50 of the support housing providing additional protection for the tubing. Thus a continuous piece of glass tubing may be bent and shaped to not only provide edge-lighting and border lighting for the display board, but to backlight the front panel 58 of the compartment 56 on which more permanent visual information may be displayed, e.g., "SPECIALS", as seen.

Thus it can be seen from the foregoing detailed description of the disclosed embodiments, the present invention provides an electrical illuminated display unit of simplified and economic construction in which the illuminated tubing and electrical components of the unit may be supportably maintained within grooves of a molded plastic support housing and wherein the grooves and housing provide tubing protection and an opaque background to concentrate light emitted therefrom in a forward direction for viewing by an observer.

What is claimed is:

1. An electric luminous display unit for conveying visual information comprising:

a housing having a unitary opaque front portion of substantially rigid molded plastic, said housing having a substantially planar face portion, said substantially planar face portion having an elongated groove therein forming an outline for at least two characters and at least one transition area between said at least two characters, said groove recessed from said planar face portion;

one continuous inert gas-containing glass tubing located in said groove and extending therethrough, said glass tubing having the outline of said at least two characters and having at least one transition between said at least two characters, said glass tubing transition further including opaque portions that are non-planar with said glass tubing outline of said at least two characters;

fasteners retaining said tubing in said groove;

electrical circuitry located behind said planar face portion for supplying electrical energy to illuminate said tubing;

wherein said housing of the unit includes a rear portion of substantially rigid molded plastic forming with said front face portion a compartment to enclose said non-planar opaque portions of the glass tubing therein, and said compartment further contains electrodes attached to ends of said glass tubing, an electrical transformer, and wiring connecting the electrical transformer to said electrodes;

whereby light from the tubing in the groove is directed forwardly of said planar face portion for viewing by the human eye.

2. The display unit according to claim 1, said housing further comprising a raised lip therearound, said raised lip having a hollow interior, and a rim of said rear portion fits within said hollow interior of said raised lip.

3. An electric luminous display unit for conveying visual information comprising:

a housing having a unitary opaque front portion of substantially rigid molded plastic, said housing having a substantially planar face portion, said substantially planar face portion having an elongated groove therein forming an outline for at least two characters and at least one transition area between said at least two characters, said groove recessed from said planar face portion;

one continuous inert gas-containing glass tubing located in said groove and extending therethrough, said glass tubing having the outline of said at least two characters and having at least one transition between said at least two characters, said glass tubing transition further including opaque portions that are non-planar with said glass tubing outline of said at least two characters;

fasteners retaining said tubing in said groove;

electrical circuitry located behind said planar face portion for supplying electrical energy to illuminate said tubing;

wherein: said tubing having opaque portions in said transition areas precluding emission of light from the tubing thereat;

light emitting portions of said glass tubing are coplanar and said opaque transition portions are non-planar with said light emitting portions;

said grooves further comprising openings therethrough at said transition areas, said non-planar opaque portions of said glass tubing are disposed in said openings and located behind said front substantially planar face portion;

whereby light from the tubing in the groove is directed forwardly of said planar face portion for viewing by the human eye.

4. An electric luminous display unit for conveying visual information comprising:

a housing having a unitary opaque front portion of substantially rigid molded plastic, said housing having a substantially planar face portion, said substantially planar face portion having an elongated groove therein forming an outline for at least two characters and at least one transition area between said at least two characters, said groove recessed from said planar face portion;

one continuous inert gas-containing glass tubing located in said groove and extending therethrough, said glass tubing having the outline of said at least two characters and having at least one transition between said at least two characters;

fasteners retaining said tubing in said groove;

electrical circuitry located behind said planar face portion for supplying electrical energy to illuminate said tubing;

whereby light from the tubing in the groove is directed forwardly of said planar face portion for viewing by the human eye;

wherein said substantially planar face portion has an additional recessed groove therein and along a perimeter of said substantially planar face portion surrounding said at least two characters, said additional groove also containing parts of said continuous glass tubing to provide a light surrounding said at least two characters.

* * * * *